United States Patent [19]

Kortenbrede

[11] Patent Number: 4,944,168

[45] **Date of Patent: * Jul. 31, 1990**

[54] CABLE LOCK

[75] Inventor: Ludger Kortenbrede, Telgte, Fed. Rep. of Germany

[73] Assignee: Aug. Winkhaus GmbH & Co. KG, Fed. Rep. of Germany

[ * ] Notice: The portion of the term of this patent subsequent to May 23, 2006 has been disclaimed.

[21] Appl. No.: 384,746

[22] Filed: Jul. 24, 1989

[30] Foreign Application Priority Data

May 18, 1989 [DE] Fed. Rep. of Germany ..... 8906146

[51] Int. Cl.[5] ..... F05B 67/06

[52] U.S. Cl. ..... 70/49; 70/54; 70/417

[58] Field of Search ..... 70/18, 30, 49, 50, 52–56, 70/416, 417

[56] References Cited

U.S. PATENT DOCUMENTS

| | | | |
|---|---|---|---|
| 613,065 | 10/1898 | House | 70/52 X |
| 1,662,612 | 3/1928 | Junkunc | 70/55 |
| 3,435,642 | 4/1969 | Del Pesco | 70/49 |
| 3,983,725 | 10/1976 | Manuel | 70/55 |
| 4,012,930 | 3/1977 | Benson | 70/49 X |
| 4,075,878 | 2/1978 | Best | 70/49 |
| 4,297,861 | 11/1981 | Dykes | 70/55 |
| 4,354,365 | 10/1982 | Mayer et al. | 70/30 |
| 4,667,491 | 5/1987 | Lokken et al. | 70/18 X |
| 4,819,464 | 4/1989 | Kuo | 70/18 |
| 4,831,849 | 5/1989 | Kortenbrede | 70/54 X |

FOREIGN PATENT DOCUMENTS

| | | | |
|---|---|---|---|
| 962322 | 4/1957 | Fed. Rep. of Germany | 70/49 |
| 8629478 | 2/1987 | Fed. Rep. of Germany . | |
| 8717397 | 6/1988 | Fed. Rep. of Germany . | |
| 979740 | 5/1951 | France | 70/49 |
| 1596781 | 8/1981 | United Kingdom | 70/49 |

*Primary Examiner*—Robert L. Wolfe
*Assistant Examiner*—Suzanne L. Dino
*Attorney, Agent, or Firm*—Toren, McGeady & Associates

[57] ABSTRACT

The cable lock has a flexible cable portion and an elongated lock body at one end of the cable portion which is enclosed by a two-part synthetic plastics casing. The plastics casing comprises a cap-shaped outercasing part which substantially completely encloses an inner casing part which fixes the lock body in its longitudinal direction. The inner casing part carries a tubular projection which together with the cable portion passes through an aperture in an end wall of the outer casing part. The inner edge of the aperture is fitted by snap-action in an annular groove in the tubular projection. The synthetic plastics casing of the cable lock is mechanically rugged and its snap-action joint is visually unobtrusive.

11 Claims, 1 Drawing Sheet

CABLE LOCK

BACKGROUND OF THE INVENTION

The invention relates to a cable lock.

Known from German Utility Model 86 29 478 is a cable lock having a flexible cable portion and an elongated lock body, on which the cable portion has a first end fixed and extending in the longitudinal direction of the lock body while a second end can be connected, extending in the longitudinal direction of the lock body. The lock body of the cable lock which is used first and foremost to protect two-wheel vehicles is enclosed in a synthetic plastics casing intended to protect the two-wheel vehicle from suffering damage to its paintwork from the lock body which consists entirely of metal. The casing which has apertures the two ends of the cable portion can pass consists of two interengageable casing parts which, when they are fitted together, can be fixed to each other by matching ratchet elements. The outer casing part is constructed as a tubular cap which annularly encloses at least a part of the longitudinal dimension of the inner casing part.

In the case of the prior art cable lock, for interengagement of the two casing parts, oppositely disposed side walls of the cap comprise holes into which catches provided on the inner housing part can engage. It has been found that the catches are not only recognizable as a ratchet connection from the outside which adversly affects the outward appearance of the casing, but that also, by virtue of the elasticity of the synthetic plastics material used for the side walls, may become unintentionally detached.

The object on which the invention is based is so to improve the prior art cable lock that the two casing parts of the synthetic plastics casing can be more permanently connected to each other, the ratchet connection between them not being visible as such or being recognizable only with difficulty.

SUMMARY OF THE INVENTION

According to the invention, the catch means are disposed in the region of one of those ends of the cap which are situated in the longitudinal direction of the lock body. One of the catch members is constructed as a radially open annular groove which lies in a plane extending substantially at right-angles to the longitudinal direction of the lock body, while in the case of the other catch member, this is an annular shoulder adapted to snap into the annular groove. The catch members are thus concealed by the cap and offer comparatively large engagement surfaces so that they lastingly connect to each other the two casing parts after the snap engagement of the locking means.

The catch members may be provided at that end of the cap which is remote from the cable portion. However since the diameter of the aperture in the cap at this end is generally greater than at the end close to the cable, the risk of unintentional opening of the connection can be alleviated if the joint is shifted to the region of those ends of the cap which are close to the cable and which are strengthened by an end wall. The inner casing part is to this end preferably provided with a tubular projection which engages over the first end of the cable portion and which, in an end wall of the cap, passes through an orifice provided to accomodate the cable portion. Expediently, the inner periphery of the orifice provided for passage forms the annular shoulder and engages an annular groove provided on the outer periphery of the extension piece.

In a preferred development, the inner casing part extends substantially over the entire length of the lock body and forms at the same time the end wall of the casing which is opposite the first end of the cable portion in the longitudinal direction of the lock body. In spite of the fact that the casing is in two parts, it is very rugged in such a construction, particularly if the cap covers the inner part of the casing substantially completely, except for the end wall and the tubular projection.

In a further expedient development, it is envisaged that the inside diameter both of the tubular projection on the inner casing part and also of the aperture in the end wall of the cap should be smaller than the diameter of the lock body. Even if the snap-action joint should become accidentally undone, this arrangement makes it difficult to lose the casing parts, since they are both hanging from the portion of the cable.

In the case of the cable lock known from German Utility Model No. 86 29 478, the lock body is fixed by abutment faces which are provided on the inner casing part on the one hand and on the outer casing part on the other. In use, this can lead to an increased loading on the snap-action joint. In a preferred development, its is therefore envisaged that both the abutment faces which are facing opposite directions in the longitudinal direction of the lock body, should be provided on the inner casing part so that in its longitudinal direction both sides of the lock body are fixed on the inner casing part. In the case of a lock body which is provided with a housing projecting transversely to the longitudinal direction of the lock body and intended to receive the pushed-in second end of the cable portion, this can be achieved easily in that the abutment faces of the inner casing part enclose the housing between them. The inner casing part can, if necessary, be provided with a pocket to accomodate the housing and the pocket walls can constitute the abutment faces.

In many cases, the lock body is basically of a rounded, for instance barrel, shape. So that the lock body can nevertheless be non-tiltably fixed in the casing, it is expedient for the inner casing part to extend substantially over the entire length of the lock body and to comprise in the region of the two ends of the lock body, viewed in the longitudinal direction, holders which enclose the lock body in the peripheral direction and which have between them, on the side remote from the abutment faces and transversely to the longitudinal direction, an aperture through which the lock body can be inserted. The inner casing part which extends over the entire length of the lock body enhances the stability of the casing even if the pocket provided to accomodate the housing is open at both ends in the direction in which the second end of the cable portion is inserted, in order that the resultant joint may facilitate insertion of the lock body into the two holders.

Expediently, the inner casing part is provided with bracing walls which extend substantially in the longitudinal direction of the lock body and which form a bed for the lock body which matches its contours in a longitudinal direction, the lock body being fixed in the bed by the cap. By an appropriate dimensioning of the bracing wall, the lock body is flexibly fixed in the casing. Furthermore, the bracing walls reinforce the casing.

The various features of novelty which characterize the invention are pointed out with particularity in the claims annexed to, and forming a part of, this disclosure. For a better understanding of the invention, its operating advantages and specific objects attained by its use, reference should be had to the accompanying drawings and descriptive matter in which there are illustrated and described preferred embodiments of the invention.

DESCRIPTION OF PREFERRED EMBODIMENTS

Figure 1:
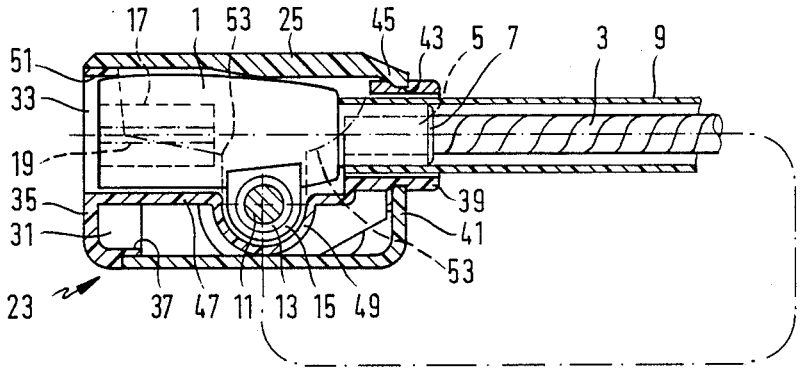
FIG. 1 is a longitudinal section through a cable lock according to the invention.
Figure 2:
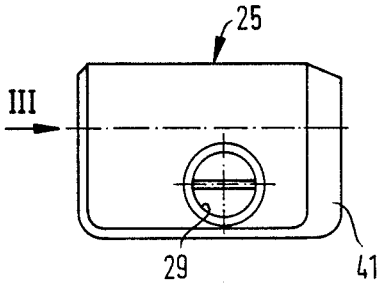
FIG. 2 is a side view of an outer casing part of a lock casing, constructed as a cap.
Figure 3:
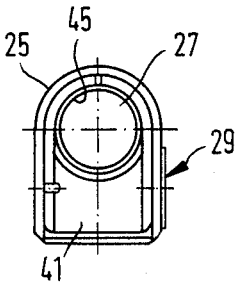
FIG. 3 is an end view of the outer casing part, viewed in the direction of an arrow III in FIG. 2.
Figure 4:
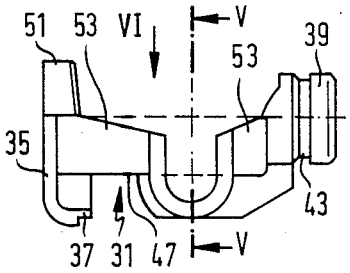
FIG. 4 is a side view of an inner casing part of the lock casing.

The cable lock shown in FIG. 1 has an elongated lock body 1 with a substantially circular cross-sectional shape and a slightly convex or barrel-shaped longitudinal section an end 5 of the portion 3 of flexible cable extending in the longitudinal direction of the lock body 1 being secured in a crimping bush 7 in the lock body 1. The cable portion 3 sheathed in a protective synthetic plastics sheath 9 carries at its other end a locking member 11 which can be inserted transversely to the longitudinal direction of the lock body 1 into a push-in guide passage 13 in a housing projecting from the lock body 1 into a push-in guide passage 13 in a housing projecting from the lock body 1 and crosswise to its longitudinal direction. Disposed in the lock body 1 and rotatable about its longitudinal axis is a cylinder core 17 of a cylinder lock, the key path 19 of which is designed to receive a key, not shown in greater detail, and has its entrance disposed on that side of the lock body 1 which is opposite the end 5 of the cable portion 3. When it is inserted into the pushing guide passage 13, the locking member 11 automatically engages the lock body 1 and can only be unlocked by means of the key.

Except for the end face of the cylinder core 17, the lock body 1 is substantially completely masked by a twopart synthetic plastics casing 23, the details of which are shown in FIGS. 2 to 6. The plastics casing 23 comprises a substantially tubular casing cap 25 in which there is an aperture 27 for the end 5 of the cable portion 3 and an aperture 29 for the locking member 11. The cap 25 extends substantially over the entire length of the lock body 1 and encloses an inner casing part 31 which likewise extends substantially over the entire length of the lock body 1, having at its end, which is remote from the cable portion 3, an end wall 35 in which there is a key insertion aperture 33. The end wall 35 closes off the cap 25 on the side remote from the cable portion 3, in a substantially flush fashion, in that the end wall 35 is enclosed on three sides by the cap 35, one narrow side having a rib 37 which engages into the cap 25. On the side which faces the cable portion 3, the inner casing part 31 is provided with a tubular projection 39 which passes through the aperture 27 in that end wall 41 of the cap 25 which is adjacent the cable portion 3 and has on its outer periphery an annular groove 43 disposed in a plane extending at right angles to the longitudinal direction of the lock body 1. The inner edge 45 of the aperture 27 engages with the annular groove 43 and locks the cap 25 on the inner casing part 31.

The inner casing part 31 has, extending along the lock body, a bottom wall 47 which in the region of the housing 15 forms a pocket 49 in which the housing 15 engages. The pocket 49 forms abutment faces which face each other in the longitudinal direction of the lock body 1 and fix the lock body 1 in both directions, in the longitudinal sense.

Crosswise to its longitudinal direction, the lock body 1 is fixed at one end by the tubular projection 39 enclosing the crimping bush 7 and at its other end by an annular portion 51 of the end wall 35 which is integrally formed on the inner casing part 31. Integrally formed on the bottom wall 47, in the longitudinal direction there are on both sides of the pocket 49 substantially longitudinally extending bracing walls 53, on the longitudinal edges of which the lock body 1 rests and is secured by the cap 25. The bracing walls 53 are so dimensioned that the lock body 1 is flexibly held in the bed formed by the bracing walls 53.

Figure 5:
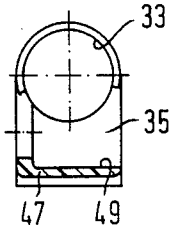
FIG. 5 is a sectional view through the inner casing part taken on a line V—V in FIG. 4.
Figure 6:
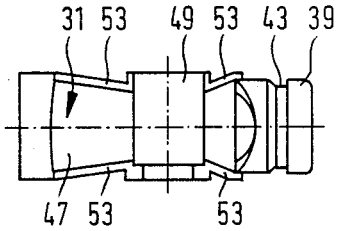
FIG. 6 is a plan view of the inner casing part viewed in the direction of an arrow VI in FIG. 4.
Figure 7:
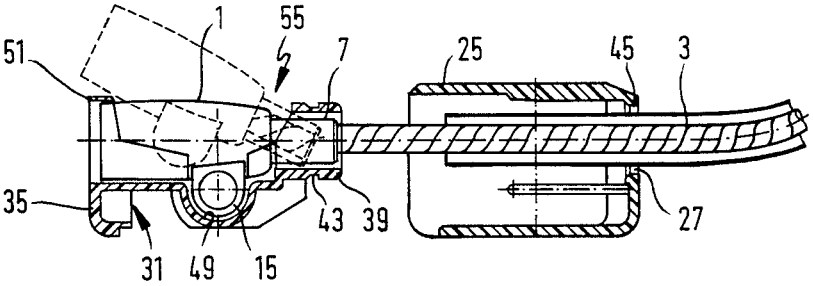
FIG. 7 is a sectional view of the cable lock and illustrates the way its components are fitted together.

For assembly, as FIG. 7 shows, firstly the inner casing part 31 and then the cap 25 are threaded onto the cable portion 3 from the end which carries the locking member 11. The lock body 1, with its housing 15 and its crimping bush 7 in front, is pushed into the inner casing part 31 through the insertion aperture 55 remaining between the tube portion 39 and the annular portion 51 of the end wall 35, as is indicated by the broken line contour of the lock body 1 as shown in the drawing. The pocket 49 provided to accommodate the housing 15 is, as is best seen in FIG. 5, open at both ends transversely to the longitudinal direction of the lock body 1 so that it forms a flexible joint via which the tube portion 39 and the annular portion 51 can be bent away from each other to enlarge the insertion aperture 55. After the lock body 1 has been inserted into the inner casing part 31, the cap 25 is pushed over the inner casing part 31 until the annular shoulder formed by the inner edge 45 of the aperture 27 snaps into place in the annular groove 43 on the tubular projection 39.

The lock casing of the aforedescribed cable lock is rugged and has a snap-action joint which is capable of withstanding even enhanced mechanical stresses without the ratchet-type members becoming visually obtrusive. The inside diameter both of the tubular projection 39 and also of the aperture 27 is smaller than the diameter of the lock body 1 so that the cap 25 and the inner casing part 31 remain secured on the cable lock by the cable portion 3 even if the snap-action joint should become separated.

While specific embodiments of the invention have been shown and described in detail to illustrate the application of the inventive principles, it will be understood that the invention may be embodied otherwise without departing from such principles.

What I claim is:

1. A cable lock comprising an elongated lock body (1), a flexible cable portion (3), having a first end (5) secured to the lock body (1) so that it extends in the longitudinal direction of the lock body (1) and having a second end (11) removably secured to the lock body (1) crosswise to the longitudinal direction of said lock body (1), and, a casing (25, 31) enclosing the lock body (1) and having apertures (27, 29) for the two ends (5, 11) of the cable portion (3) and consisting of a synthetic plastic material, said casing (25, 31) comprising an outer casing part (25) being constructed as a tubular cap (25) and an inner casing part (31) fitted into the outer casing part (25) in the longitudinal direction of the lock body (1), said outer casing part (25) annularly enclosing the inner casing part (31) at least over a portion of its longitudinal dimension, mutually complementary snap-action members (43, 45) disposed in the region of one of the ends of the outer casing part (25) seen in the longitudinal direction of the lock body, one of the snap-action members being constructed as a radially open annular groove (43) disposed in the plane extending substantially at rightangles to the longitudinal direction of the lock body (1) while the other snap-action member is constructed as an annular shoulder (45) adapted to snap into place in the annular groove (43).

2. A cable lock according to claim 1, wherein the inner casing part (31) comprises, enclosing the first end (5) of the cable portion (3), a tubular projection (39) which passes through an aperture (27) provided in an end wall (41) of the outer casing part (25) through which the cable portion (3) is intended to pass, and wherein the annular groove (43) is provided on the outer periphery of the tubular projection (39) while the annular shoulder (45) is provided on the inner periphery of the aperture (27).

3. A cable lock according to claim 2, wherein the inner casing part (31) extends substantially over the entire length of the lock body (1) and forms and end wall (35) of the casing (25, 31) which is opposite the first end (5) of the cable portion (3) in the longitudinal direction of the lock body (1).

4. A cable lock according to claim 3, wherein the outer casing part (25) substantially completely covers the inner casing part (31) except for its tubular projection (39) and its end wall (35).

5. A cable lock according to claim 2, wherein the inside diameter both of the tubular projection (39) of the inner casing part (31) and also of the aperture (27) in the end wall (41) of the cap (25) is smaller than the diameter of the lock body (1).

6. A cable lock according to claim 1, wherein the inner casing part (31) has in the longitudinal direction of the lock body (1) oppositely directed abutment faces which secure the lock body (1) in both directions in its longitudinal sense.

7. A cable lock according to claim 6, wherein the lock body (1) comprises for connection of the second end (11) of the cable portion (3), a housing (15) which projects transversely in relation to the longitudinal direction and which comprises a push-in guide passage (13) into which the second end (11) of the cable portion (3) can be inserted, and wherein the abutment faces of the inner casing part (31) are directed at each other and enclose the housing (15) between them.

8. A cable lock according to claim 7, wherein the inner casing part (31) extends substantially over the total length of the lock body (1) and has in the region of the two ends of the lock body (1), in a longitudinal direction, holders (39, 51) which enclose the lock body (1) in a peripheral direction and further comprises between the holders (39, 51) on the side remote from the abutment faces and transversely to the longitudinal direction an aperture (55) into which the lock body (1) can be inserted.

9. A cable lock according to claim 8, wherein the inner casing part (31) comprises, to accommodate the housing (15), a pocket (49) the walls of which form the abutment faces.

10. A cable lock according to claim 9, wherein the pocket (49), in the direction in which the second end (11) of the cable portion (3) is inserted, is open on both sides of the housing (15) and forms a flexible joint which, when the lock body (1) is inserted, makes it possible to bend the two holders (39, 41) open in relation to each other.

11. A cable lock according to claim 8, wherein the inner casing part (31) comprises extending substantially in the longitudinal direction of the lock body (1), bracing walls (53) which form a bed adapted in a longitudinal direction to the contours of the lock body (1) which it is intended to accommodate and wherein the outer casing part (25) fixes the lock body (1) in the bed transversely to the longitudinal direction.

* * * * *